US006021762A

United States Patent [19]

Zeidler et al.

[11] Patent Number: 6,021,762

[45] Date of Patent: Feb. 8, 2000

[54] SEAM TEST ON A FUEL INJECTION PUMP, AND THE FUEL INJECTION PUMP REQUIRED FOR APPLYING SAME

[75] Inventors: Dirk Zeidler, Dusslingen; Dieter Schaible, Reutlingen; Vito Tricasi, Weilimdorf, all of Germany

[73] Assignee: Robert Bosch GmbH, Stuttgart, Germany

[21] Appl. No.: 09/125,428

[22] PCT Filed: Sep. 9, 1997

[86] PCT No.: PCT/DE97/01996

§ 371 Date: Aug. 19, 1998

§ 102(e) Date: Aug. 19, 1998

[87] PCT Pub. No.: WO98/27335

PCT Pub. Date: Jun. 25, 1998

[30] Foreign Application Priority Data

Dec. 19, 1996 [DE] Germany ..... 196 53 055

[51] Int. Cl.[7] ..... F02M 37/04

[52] U.S. Cl. ..... 123/509; 123/470; 73/119 A

[58] Field of Search ..... 123/470, 495, 123/509, 198 D; 73/119 A

[56] References Cited

U.S. PATENT DOCUMENTS

| | | | |
|---|---|---|---|
| 3,125,028 | 3/1964 | Reiners | 123/470 |
| 4,246,877 | 1/1981 | Kennedy | 123/470 |
| 4,428,228 | 1/1984 | Banz Haf | 73/119 A |
| 4,559,815 | 12/1985 | Needham | 123/470 |
| 4,571,161 | 2/1986 | LeBlanc | 123/509 |
| 5,007,401 | 4/1991 | Grohn | 123/509 |
| 5,195,362 | 3/1993 | Eason | 73/119 A |
| 5,325,834 | 7/1994 | Ballheimer | 123/470 |
| 5,402,944 | 4/1995 | Pape | 239/600 |
| 5,625,946 | 5/1997 | Wildeson | 239/600 |
| 5,715,786 | 2/1998 | Seiberth | 73/119 A |
| 5,720,436 | 2/1998 | Buschor | 239/600 |
| 5,730,101 | 3/1998 | Aupperle | 123/470 |

FOREIGN PATENT DOCUMENTS

| | | | |
|---|---|---|---|
| 0461212 | 12/1991 | European Pat. Off. | 123/470 |

*Primary Examiner*—Carl S. Miller
*Attorney, Agent, or Firm*—Edwin E. Greigg; Ronald E. Greigg

[57] ABSTRACT

A process for leak testing in fuel injection pumps that have a pump housing that can be plugged into a motor housing, in which an outlet of the fuel injection pump, which feeds into an annular chamber that is divided by sealing rings and is normally discharged by way of a line, is closed with a material in order to carry out a leak test. The material is plastically deformable and dissolves with the heating of the fuel, and due to its plasticity, produces a sealed closure of the annular chamber in relation to the interior of the fuel injection pump so that the annular chamber can be loaded with a testing pressure via the line.

8 Claims, 2 Drawing Sheets

SEAM TEST ON A FUEL INJECTION PUMP, AND THE FUEL INJECTION PUMP REQUIRED FOR APPLYING SAME

PRIOR ART

The invention is based on a process for leak testing in a fuel injection pump, with a pump housing that can be plugged into a motor housing and in its jacket face that is encompassed by the wall of a recess of the fuel injection pump in the motor housing. The fuel injection pump has an inlet for fuel to be supplied to a pump work chamber of the fuel injection pump and an outlet for fuel to be returned, which outlet feeds into a first annular chamber that is sealed in relation to the outside by means of a first seal clamped between the jacket face of the pump housing and the wall of the recess and is sealed in relation to the inlet by means of a second seal clamped between the jacket face of the pump housing and the wall of the recess, and the fuel supply of the inlet is carried out from a second annular chamber that is disposed between the jacket face of the pump housing and the wall of the recess and is divided from the first annular chamber by means of the second seal and is sealed on the other end in relation to the outside by means of a third seal clamped between the jacket face of the pump housing and the wall of the recess, wherein the inlet and the outlet communicate with each other inside the pump housing at least by way of a throttle connection.

Fuel injection pumps of the above-mentioned type with annular chambers, which have to be leak tested, have been disclosed for example by means of EP 0 461 212. In the execution of a leak test, problems arise by virtue of the fact that inside the pump housing between the inlet and the outlet, hydraulic short circuits exist at least by way of throttle connections so that an isolated test of the above-mentioned seals can only be partially executed. The seals disposed toward the outside, the above-mentioned first seal and the third seal, can be tested without great trouble. Due to the hydraulic short circuit, though, the testing of the second seal as a seal between the first annular chamber and the second annular chamber is not easily possible. To make things more difficult, a seal of this kind should be able to be leak tested, particularly upon final installation of the fuel injection pump into the motor housing. However, the leakage quantity that flows, e.g. via a throttle gap at the pump piston of the fuel injection pump or via a throttled cooling circuit, inhibits this testing.

ADVANTAGES OF THE INVENTION

The process according to the invention has the advantage that a leak testing of the second seal can be easily and reliably executed. Since the material introduced into the outlet at the pump housing dissolves when the fuel heats up, the fuel injection pump advantageously no longer needs to be taken out in order to remove this sealing material, which would have the risk that a previously established leakproofness would be lost after reinstallation. A design of this kind would also be connected with additional assembly costs. In accordance with the process set forth herein, the full functioning of the fuel injection pump can advantageously be produced very rapidly in such a way that the closure of the outlet is completely and immediately neutralized and thus the action of a delivery pump supplying the fuel injection pump with low pressure fuel is not impaired. With the subsequent heating, the material dissolves in the fuel and is supplied for combustion along with the fuel.

When testing, the outlet is advantageously closed with the material. It is also possible, though, with the corresponding embodiment of the inlet, to close the inlet as well for testing purposes.

A fuel injection pump for carrying out the process sets forth in that the outlet or the inlet into which the material is to be introduced widens toward the first or second annular chamber so that when pressure acts on the respective annular chamber, this material closes the outlet or the inlet in relation to the pump interior after the fashion of a check valve. The embodiment of the outlet or the inlet at this point is carried out such that they narrow in a funnel shape toward the pump interior or this region is embodied as a stepped bore with a conical transitional face between the larger diameter stepped bore part on the annular chamber end and the smaller diameter stepped bore part.

BRIEF DESCRIPTION OF THE DRAWINGS

An exemplary embodiment of the invention is represented in the drawings and will be described in detail below.

DESCRIPTION OF THE EXEMPLARY EMBODIMENT

Figure 1:
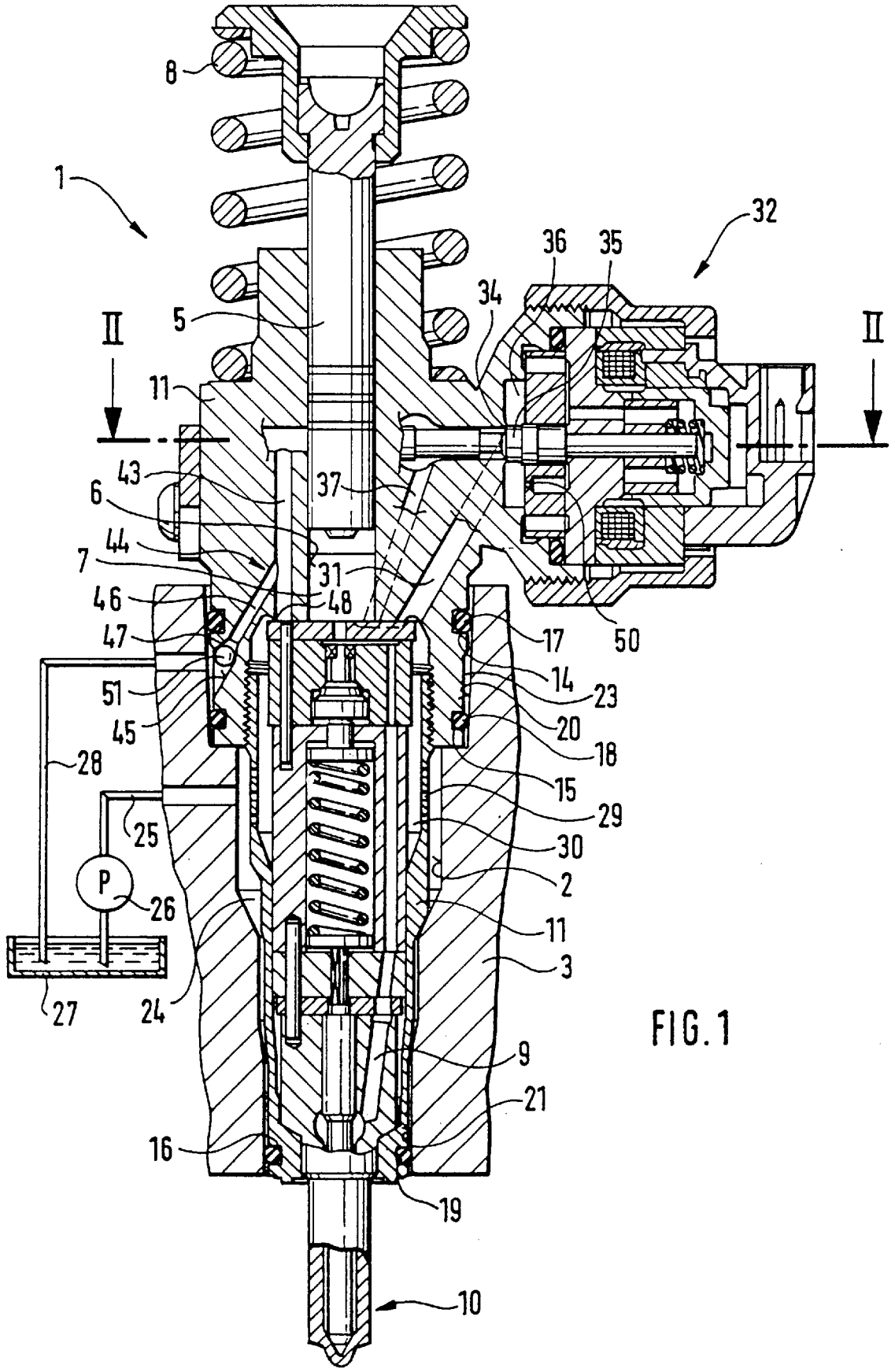
FIG. 1 is a longitudinal section through a fuel injection pump inserted into a motor housing and FIG. 2 is a section through this fuel injection pump according to FIG. 1 along the line II—II.

The fuel injection pump depicted in FIG. 1 is a so-called unit fuel injector 1, which is inserted into a recess 2 of a motor housing 3. Unit fuel injectors of this kind have a pump piston 5, which is set into a reciprocating motion by a drive belonging to the motor. The pump piston encloses a pump work chamber 7 in a cylinder bore 6, from which fuel is supplied to a fuel injection valve 10 by way of a pressure line 9 when the pump piston is moved counter to the force of a restoring spring 8. The pump piston, the pump work chamber, and the fuel injection valve are accommodated in a common housing 11 comprised of housing parts that are screwed together. Unit fuel injectors are distinguished by the fact that extremely short connections between the pump work chamber 7 and the fuel injection point at the fuel injection nozzle 10 can be produced, wherein the fuel line 9 to be connected is guided inside a dimensionally stable housing instead of being embodied, as is otherwise commonly the case, as an elastically deformable fuel tube line, which impairs the injection by means of its absorption volume.

On the jacket face of its housing 11, which is disposed inside the recess 2, the unit fuel injector has a first annular groove 14, a second annular groove 15, and a third annular groove 16 into which a first seal 17, a second seal 18, and a third seal 19 are correspondingly inserted. When the pump housing 11 is inserted into the recess 2, these seals are in sealed contact with the adjoining inner jacket surfaces 20, and 21 of the recess 2. In this manner, between the outer jacket face of the housing 11 and the inner jacket face of the recess 2, a first annular chamber 23 is enclosed between the first seal 17 and the second seal 18, and a second annular chamber 24 is enclosed between the second seal 18 and the third seal 19. The second annular chamber 24 is fed by the supply line 25 of a fuel delivery pump 26, which delivers fuel at supply pressure to the annular chamber 24 from a fuel reservoir 27. A line 28 leads to the discharge side from the first annular chamber 23.

Figure 2:
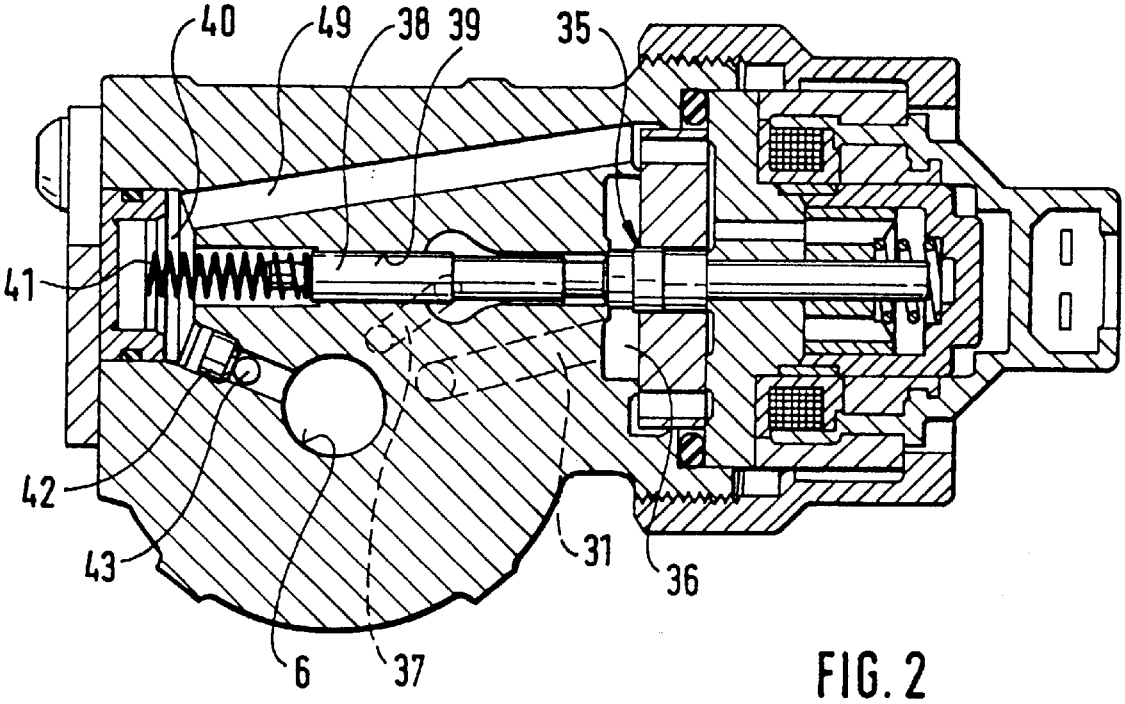

From the second annular chamber, the supplied fuel travels via an inlet constituted by a bore 29 in the wall of the housing 11 into an annular chamber 30 disposed on the inside, from which the fuel is supplied to a solenoid valve 32 via a connecting line 31. Instead of an individual bore, a number of bores 29 can be provided, as shown in the drawings. The connecting line feeds into an annular chamber 36 that encloses a valve seat 34 of the valve member 35 of the solenoid valve, and when the solenoid valve member 35 is opened during the intake stroke of the pump piston, fuel travels from this annular chamber 36 into the pump work chamber via an inlet and outlet line 37. When the solenoid valve is open during the compression stroke, the injection quantity not needed is fed back into the annular chamber 24 by the same path. As can be inferred from FIG. 2, during the high pressure delivery stroke of the pump piston, the valve member is loaded by means of the pressure prevailing against the valve member by way of the filling and discharge line 37 so that a force compensation takes place at the valve member. To that end, the valve member 35 has a guide piston 38, which is guided in a guide bore 39 of the housing 11. A leakage quantity flowing past this guide piston travels into a leakage chamber 40, which also contains a spring 41 that loads the valve member in the opening direction, and from this leakage chamber, travels via a throttle 42 to a return conduit 43, which is in turn visible in FIG. 1, back to an outlet 44, which feeds into the first annular chamber 23. This outlet 44 is embodied as a stepped bore, with a larger diameter stepped bore part 45 disposed toward the end of the first annular chamber 23 and a smaller diameter stepped bore part 46 disposed toward the end of the return conduit 43. The transition between the stepped bore part 45 and the stepped bore part 46 is effected by means of a cone 47.

The return conduit 43, which transitions into the stepped bore part 46, furthermore has a connection to the annular chamber 30 via a throttle location 48. Moreover, a scavenging line 49 leads between the leakage chamber 40 and the solenoid valve and feeds into cooling chambers that encompass the solenoid valve, from which in turn, a connection to the annular chamber 36 of the solenoid valve is produced by means of a throttle 50. Also, the pump work chamber 7 has a leakage connection to the return conduit 43 by means of a play of the pump piston 5 (see FIG. 2).

It is clear that due to the connections mentioned, the second annular chamber 30 has a throttled connection to the outlet 44 via a number of locations and these connections cannot be easily closed for testing purposes.

According to the invention, a material is now introduced into the outlet or into the larger diameter stepped bore part 45 for testing purposes, and this material plastically deforms and in particular, dissolves when the fuel heats up. A material of this kind can be produced, for example, based on wax and for testing purposes, is introduced in the form of pre-formed pellets into the stepped bore part 45 in order to close the outlet 44 in a sealed fashion before the insertion of the fuel injection pump into the recess 2. Then, in opposition to the other pressure connections, the first annular chamber 23, e.g. at the outlet of the line 28, is supplied with a testing pressure via a testing pressure connection in such a way that the pressure prevailing in the annular chamber 23 then presses the wax pellet, or the pellet comprised of similar material, onto the conical transition between the stepped bore parts for the final sealed closure of the outlet. After this, the second seal 18 can now also be leak tested. A gaseous medium is preferably used as the pressure medium. Then, by means of a reverse application of pressure, this pellet can be rapidly expelled again so that no line narrowings occur here which would hinder the startup of the fuel delivery pump 26 in a self-aspirating manner. Then as the fuel heats up, the expelled pellet dissolves into it and is carried away along with the fuel and if need be, is also supplied to the combustion chamber. In the instances in which the fuel supply of the fuel injection pump is noncritical with regard to the startup behavior, this method can be omitted and the dissolving of the pellet 52 can be left up to the temperature increase of the fuel.

The leak testing of the seals 17 to 19 can be carried out either by means of visual testing or the pressure retaining capability of the annular chamber is detected with a previously-generated application of pressure. After this, an individual testing of the seals 17, 18, or 19 defining the chamber can be carried out.

The foregoing relates to preferred exemplary embodiments of the invention, it being understood that other variants and embodiments thereof are possible within the spirit and scope of the invention, the latter being defined by the appended claims.

We claim:

1. A process for leak testing in a fuel injection pump with a pump housing (11) that can be plugged into a motor housing (3) and in its jacket face that is encompassed by the wall of a recess (2) of the fuel injection pump in the motor housing (3), said pump housing (11) has an inlet (29) for fuel to be supplied to a pump work chamber (7) of the fuel injection pump from a reservoir (27) by a delivery pump (26) and an outlet (44) for fuel to be returned to said reservoir, said outlet (44) feeds into a first annular chamber (23) that is sealed in relation to the outside by means of a first seal (17) clamped between the jacket face of the pump housing (11) and the wall of the recess (2) and is sealed in relation to the inlet (29) by means of a second seal (18) clamped between the jacket face of the pump housing (11) and the wall of the recess (2), and the fuel supply of the inlet (29) is carried out from a second annular chamber (24) that is disposed between the jacket face of the pump housing (11) and the wall of the recess (2) and is divided from the first annular chamber (23) by means of the second seal (18) and is sealed on the other end in relation to the outside by means of a third seal (19) clamped between the jacket face of the pump housing (11) and the wall of the recess (2), wherein the inlet (29) and the outlet (44) communicate with each other inside the pump housing (11) at least by way of a throttle connection (48), the process comprising closing the outlet (44) from the pump housing (11) or the inlet (29) through an insertion of a heat dissolving part (51) comprised of a plastically deformable material that dissolves in fuel, particularly with a heating up of the fuel, inserting the pump housing (11) into the recess (2) of the motor housing (3) or into a testing recess and subjecting the first annular chamber (23) or the second annular chamber (24) correspondingly associated with the closed outlet or inlet to a pressure medium brought to a testing pressure, said pressure medium including a gaseous pressure medium, detecting a pressure decrease or medium escape from the respective side of the seals (17, 18, 19) remote from the first annular seal (23) or second annular chamber (24) as a signal for a leak.

2. The process according to claim 1, in which after the testing is carried out, the outlet (44) or the inlet (19) is subjected to a pressure acting in the direction of the first annular chamber (23) or the second annular chamber (24), by means of which the heat dissolving part (51) can be expelled into the first annular chamber (23) or the second annular chamber (24).

3. A fuel injection pump comprising a pump housing (11) that can be plugged into a motor housing (3), said pump housing, on a jacket face encompassed by a wall of a recess (2) of the fuel injection pump in the motor housing (3), has an inlet (29) for fuel to be supplied to a pump work chamber (7) of the fuel injection pump (1) and an outlet (44) for fuel to be returned from a delivery pump (26), which outlet (44) feeds into a first annular chamber (23) that is sealed in relation to the outside by means of a first seal (17) clamped between the jacket face of the pump housing (11) and the wall of the recess (2) and is sealed in relation to the inlet (29) by means of a second seal (18) clamped between the jacket face of the pump housing (11) and the wall of the recess (2), and the fuel supply of the inlet (29) is carried out from a second annular chamber (24) that is disposed between the jacket face of the pump housing (11) and the wall of the recess (2) and is divided from the first annular chamber (23) by means of the second seal (18) and is sealed on the other end in relation to the outside by means of a third seal (19) clamped between the jacket face of the pump housing (11) and the wall of the recess (2), wherein the inlet (29) and the outlet (44) communicate with each other inside the pump housing (11) at least by way of a throttle connection (48, 50, 42), and that the outlet (44) and/or the inlet (29) widens out in the direction of the first annular chamber (23) or the second annular chamber (24).

4. The fuel injection pump according to claim 3, in which the outlet (44) or the inlet (29) is embodied as a stepped bore (45), with a larger diameter stepped bore part (45) disposed toward the end of the first annular chamber (23) or the second annular chamber (24) and this larger diameter stepped bore part preferably transitions into the smaller diameter stepped bore part (46) with a conical transition face (47).

5. The fuel injection pump according to claim 3, in which the outlet (44) or the inlet (29) widens out conically in the direction of the first annular chamber (23) or the second annular chamber (24).

6. The fuel injection pump according to claim 1, in which the plastically deformable material is wax or a waxy material.

7. The fuel injection pump according to claim 1, in which the plastically deformable material is wax or a waxy material.

8. The fuel injection pump according to claim 1, in which the plastically deformable material is wax or a waxy material.

* * * * *